US008783827B2

(12) United States Patent
Hirabayashi

(10) Patent No.: US 8,783,827 B2
(45) Date of Patent: Jul. 22, 2014

(54) FLUID EJECTING APPARATUS

(75) Inventor: Naoto Hirabayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 13/155,668

(22) Filed: Jun. 8, 2011

(65) Prior Publication Data

US 2011/0304676 A1 Dec. 15, 2011

(30) Foreign Application Priority Data

Jun. 11, 2010 (JP) ..... 2010-134237

(51) Int. Cl.

| | |
|---|---|
| ***B41J 2/17*** | (2006.01) |
| ***B41J 29/38*** | (2006.01) |
| ***B41J 2/175*** | (2006.01) |
| ***B41J 2/165*** | (2006.01) |

(52) U.S. Cl.

CPC *B41J 2/175* (2013.01); *B41J 29/38* (2013.01); *B41J 2/16523* (2013.01)

USPC ..... 347/36; 347/30; 347/22; 347/84; 347/85

(58) Field of Classification Search

USPC ..... 347/32, 29, 36, 31, 30, 85

See application file for complete search history.

(56) References Cited

U.S. PATENT DOCUMENTS

| | | | | |
|---|---|---|---|---|
| 5,210,550 | A * | 5/1993 | Fisher et al. | 347/29 |
| 5,572,243 | A * | 11/1996 | Hermanson | 347/29 |
| 5,717,444 | A | 2/1998 | Sugimoto et al. | |
| 7,828,422 | B2 * | 11/2010 | Kimura et al. | 347/86 |
| 8,210,667 | B2 * | 7/2012 | Saeki et al. | 347/85 |
| 2002/0008728 | A1 * | 1/2002 | Usui et al. | 347/29 |
| 2006/0132554 | A1 * | 6/2006 | Ota et al. | 347/85 |
| 2006/0176333 | A1 * | 8/2006 | Momose et al. | 347/30 |
| 2008/0211860 | A1 * | 9/2008 | Yamaguchi et al. | 347/30 |
| 2009/0201336 | A1 * | 8/2009 | Yamamoto et al. | 347/36 |
| 2009/0237424 | A1 * | 9/2009 | Martin et al. | 347/6 |
| 2010/0020125 | A1 * | 1/2010 | Miyazawa | 347/30 |
| 2010/0149289 | A1 * | 6/2010 | Saeki et al. | 347/85 |

FOREIGN PATENT DOCUMENTS

| | | |
|---|---|---|
| JP | 03293150 | 12/1991 |

* cited by examiner

*Primary Examiner* — Matthew Luu
*Assistant Examiner* — Lily Kemathe
(74) *Attorney, Agent, or Firm* — Workman Nydegger

(57) ABSTRACT

A fluid ejecting apparatus has a configuration in which the volume of a reference space having an upper limit at the bottom of the fluid outlet port in the vertical direction in the fluid tank in a first state for ejecting the fluid from the fluid ejecting head to the fluid receiving unit is smaller than the volume of a space having an upper limit at the bottom of the fluid inlet port in the vertical direction in the fluid tank in a second state that is inclined by 90 degrees with respect to the first state.

7 Claims, 5 Drawing Sheets

FLUID EJECTING APPARATUS

BACKGROUND

1. Technical Field

The present invention relates to fluid ejecting apparatuses.

2. Related Art

Fluid ejecting apparatuses such as an ink jet printing device (hereinafter simply referred to as "printing device") are widely known in which fluid is ejected onto a target through nozzle openings which are formed in the ejection surface of the head. Specifically, as an example of such a printing device, JP-A-03-293150 discloses a printing device that is configured to eject fluid onto a target with the ejection surface of the head being inclined with respect to the horizontal plane (for example, positioned vertically).

Such a printing device having so-called vertical head also performs a suctioning operation for purging viscous ink or the like from the head in order to prevent the nozzle openings from becoming clogged with viscous ink and to remove air bubbles or dust contained in ink within the head.

When performing such a suctioning operation, a cap member is positioned, for example, so as to oppose the ejection surface of the head. In this case, an ink absorbent material is placed, for example, inside the cap member in order to prevent ink from being spilled, since the opening of the cap member (the portion which seals the ejection surface) is oriented laterally during the suctioning operation.

However, the printing device having the above mentioned configuration may be inclined (for example, when the printing device falls) or upside down (for example, during transportation). In this case, ink may flow, for example, toward the opening of the cap member, causing ink to be deposited on the ejection surface of the head during a capping operation or the like.

SUMMARY

An advantage of some aspects of the invention is that a fluid ejecting apparatus that is capable of preventing the ejection environment from deteriorating is provided.

According to an aspect of the invention, a fluid ejecting apparatus includes a fluid ejecting head having an ejection surface that ejects fluid, a fluid receiving unit that receives the fluid ejected from the fluid ejecting head, a fluid tank having a fluid chamber that stores the fluid that humidifies the ejection surface, a suction unit that suctions the fluid chamber, a fluid inlet unit through which the fluid which has been received in the fluid receiving unit flows into the fluid chamber via a fluid inlet port, the fluid inlet port being formed in the fluid chamber to be connected to the fluid receiving unit and a fluid outlet unit through which the fluid in the fluid chamber flows into the suction unit via a fluid outlet port, the fluid outlet port is formed in the fluid chamber to be connected to the suction unit, wherein the fluid inlet port and the fluid outlet port are arranged such that the volume of a reference space which is located below the fluid outlet port in the vertical direction in the fluid chamber of the fluid tank in a first state for ejecting the fluid from the fluid ejecting head is smaller than the volume of a space which is located below the fluid inlet port in the vertical direction in the fluid chamber of the fluid tank in a second state that is inclined by 90 degrees with respect to the first state.

Accordingly, the fluid contained in the fluid chamber of the fluid tank in the first state corresponds to the reference volume of the space which is located below the ink outlet port in the vertical direction (the volume of the reference space). In addition, the reference volume is smaller than the volume of the space which is located below the fluid inlet port in the vertical direction in the fluid chamber of the fluid tank in a second state. Accordingly, even when the fluid tank is in the second state, the top surface of the fluid is below the fluid inlet port in the vertical direction. Therefore, the fluid is not in contact with the fluid inlet port, thereby preventing the fluid in the fluid chamber from flowing back into the fluid receiving unit through the fluid inlet port. This makes it possible to prevent the fluid from being deposited on the ejection surface, thereby preventing the ejection environment from deteriorating.

According to above aspect of the invention, the fluid ejecting apparatus includes the fluid inlet port and the fluid outlet port which are arranged such that the volume of a space which is located below the fluid outlet port in the vertical direction in the fluid chamber of the fluid tank in a second state is larger than the reference volume. Accordingly, even when the fluid tank is in the second state, the top surface of the fluid is below the fluid outlet port in the vertical direction. Therefore, the fluid is not in contact with the fluid outlet port, thereby preventing the fluid in the fluid chamber from being excessively flowing out from the fluid outlet port. This makes it possible to retain the fluid in the fluid chamber with certainty, which allows the ejection surface to be humidified, thereby preventing the ejection environment from deteriorating.

According to above aspect of the invention, the fluid ejecting apparatus includes the fluid inlet port and the fluid outlet port which are arranged such that the volume of a space which is located below the fluid inlet port in the vertical direction in the fluid chamber of the fluid tank in a third state which is inclined by 180 degrees with respect to the first state is larger than the reference volume. Accordingly, even when the fluid tank is in the third state, the top surface of the fluid is below the fluid inlet port in the vertical direction. Therefore, the fluid is not in contact with the fluid inlet port, thereby preventing the fluid in the fluid chamber from flowing back into the fluid receiving unit through the fluid inlet port. This makes it possible to prevent the fluid from being deposited on the ejection surface, thereby preventing the ejection environment from deteriorating.

According to above aspect of the invention, the fluid ejecting apparatus includes the fluid inlet port and the fluid outlet port which are arranged such that the volume of a space which is located below the fluid outlet port in the vertical direction in the fluid chamber of the fluid tank in the third state is larger than the reference volume. Accordingly, even when the fluid tank is in the third state, the top surface of the fluid is below the fluid outlet port in the vertical direction. Therefore, the fluid is not in contact with the fluid outlet port, thereby preventing the fluid in the fluid chamber from being excessively flowing out from the fluid outlet port. This makes it possible to retain the fluid in the fluid chamber with certainty, which allows the ejection surface to be humidified, thereby preventing the ejection environment from deteriorating.

According to above aspect of the invention, the fluid ejecting apparatus includes the fluid tank that stores the fluid in the fluid chamber. Accordingly, the fluid is stored in the fluid chamber, thereby preventing the fluid from flowing back into the fluid receiving unit and also preventing the fluid from flowing out from the fluid chamber.

According to above aspect of the invention, the fluid ejecting apparatus includes the fluid ejecting head that is arranged so that the ejection surface is inclined with respect to the horizontal plane. Accordingly, when the fluid ejecting head is arranged so that the ejection surface is inclined with respect to the horizontal plane, it is possible to prevent the fluid from flowing back into the fluid receiving unit and also prevent the fluid from flowing out from the fluid chamber, thereby preventing the ejection environment from deteriorating.

According to above aspect of the invention, the fluid ejecting apparatus includes the fluid receiving unit that is provided so as to be capable of forming a sealed space between the fluid receiving unit and the ejection surface and has an air release port that is capable of allowing communication between the sealed space and air. Accordingly, when the fluid receiving unit is provided so as to be capable of forming a sealed space between the fluid receiving unit and the ejection surface and has an air release port that is capable of allowing communication between the sealed space and air, a problem such as that the air release port is clogged with the fluid which flows back into the air release port can be eliminated. This makes it possible to provide a fluid ejecting apparatus with a high reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
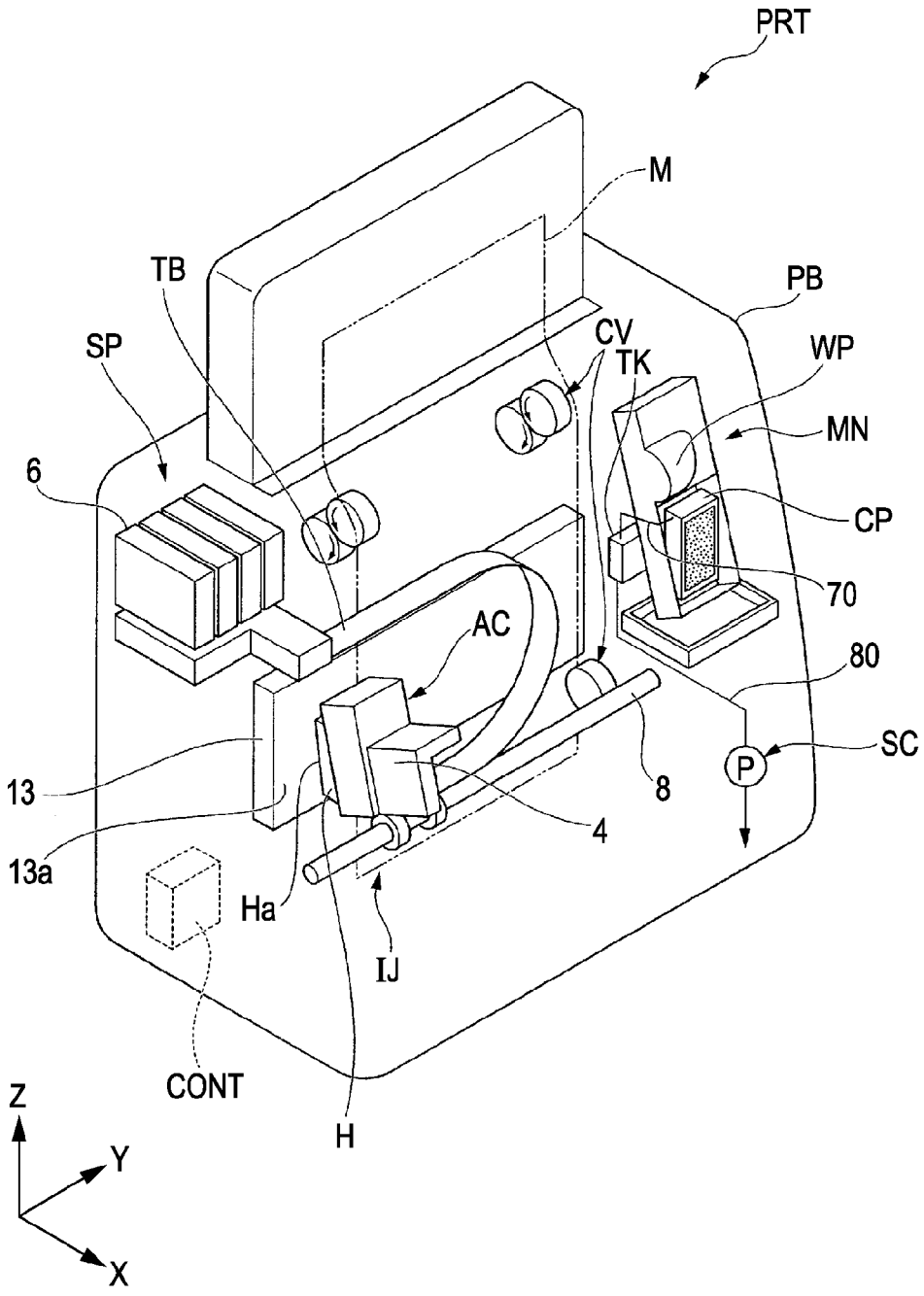
FIG. 1 is a schematic view of a printing device according to an embodiment of the present invention.

An embodiment of the invention will be described below with reference to the attached drawings. FIG. 1 schematically shows a configuration of a printing device PRT (liquid ejecting apparatus) according to an embodiment of the invention. In this embodiment, a printing device of an ink jet type will be described as an example of the printing device PRT.

The printing device PRT shown in FIG. 1 is a device that performs printing on a sheet medium M such as a paper sheet or a plastic sheet while transporting the sheet medium M. The printing device PRT includes a housing PB, an ink jet mechanism IJ that ejects ink onto the medium M, an ink supplying mechanism SP that supplies ink to the ink jet mechanism IJ, a transportation mechanism CV that transports the medium M, a maintenance mechanism MN that performs a maintenance operation on the ink jet mechanism IJ and a controller CONT that controls each of the mechanisms.

The positional relationship between the components will be explained hereinafter with reference to an XYZ Cartesian coordinate system as appropriate. In this embodiment, a predetermined direction in the horizontal plane is defined as the X direction, a direction perpendicular to the X direction in the horizontal plane is defined as the Y direction, and a direction vertical to the horizontal plane is defined as the Z direction. Further, a rotation direction about the X axis is defined as a θX direction, a rotation direction about the Y axis is defined as a θY direction, and a rotation direction about the Z axis is defined as a θZ direction.

The housing PB has a longitudinal direction, for example, in the Y direction. The housing PB is provided with the ink jet mechanism IJ, the ink supplying mechanism SP, the transportation mechanism CV, the maintenance mechanism MN and the controller CONT. For example, the housing PB is provided with a platen 13 which is a support member that supports the medium M. The platen 13 has a flat surface 13*a* which is oriented, for example, in the positive X direction. The flat surface 13*a* is used as a support surface that supports the medium M.

The transportation mechanism CV includes, for example, a transportation roller and a motor that actuates the transportation roller. The transportation mechanism CV works, for example, to transport the medium M from the positive Z axis side of the housing PB into the inside of the housing PB and discharge the medium M from the positive X axis side, the negative X axis side or the positive Z axis side of the housing PB to outside the housing PB. The transportation mechanism CV transports the medium M such that the medium M passes over the platen 13 within the housing PB. The transportation mechanism CV controls the timing of transportation, the transportation distance and the like, for example, by using the controller CONT.

The ink jet mechanism IJ includes a head H that ejects ink and a head actuating mechanism AC that holds and moves the head H. The head H ejects ink onto the medium M which has been fed onto the platen 13. The head H has an ejection surface Ha which is configured to eject ink. The head H is positioned such that the ejection surface Ha is in a state inclined with respect to the horizontal plane (XY plane). The term "inclined state" as used herein includes, for example, a state vertical with respect to the horizontal plane. The term "vertically" as used herein refers to a state inclined with respect to the horizontal plane by an angle from 85 degrees up to 95 degrees. Further, the inclined state includes a state inclined with respect to the horizontal plane, for example, by an angle of 40 degrees or more and less than 85 degrees. The ejection surface Ha is arranged, for example, so as to oppose the support surface 13*a* of the platen 13.

The head actuating mechanism AC includes a carriage 4. The head H is secured to the carriage 4. The carriage 4 abuts a guiding shaft 8 which extends in the longitudinal direction (Y direction) of the housing PB. The head actuating mechanism AC includes the carriage 4, as well as a pulse motor which is not shown, a driving pulley, a free rolling pulley, a timing belt and the like. The carriage 4 is connected to the timing belt. As the timing belt rotates, the carriage 4 is movable in the Y direction. The carriage 4 is guided by the guiding shaft 8 while being moved in the Y direction.

The ink supplying mechanism SP supplies ink to the head H. The ink supplying mechanism SP houses, for example, a plurality of ink cartridges 6. The printing apparatus PRT according to this embodiment is configured such that the ink cartridge 6 is housed at a different position from the head H (off-carriage type). The ink supplying mechanism SP includes a supply tube TB that connects, for example, the head H and the ink cartridge 6. The ink supplying mechanism SP includes a pump mechanism, which is not shown, that supplies ink which is contained in the ink cartridge 6 to the head H via the supply tube TB. This embodiment uses ink in which pigment components are dissolved or dispersed in medium components (solvent or disperse medium).

The maintenance mechanism MN is placed at a home position in the head H. The home position is located outside the area where printing is performed on the medium M or the like. In this embodiment, the home position is located, for example, on the positive Y axis side of the platen 13. The home position is a position where the head H is positioned during standby, for example, when the printing apparatus PRT is powered off or does not perform printing for a long period of time.

The maintenance mechanism MN includes, for example, a capping mechanism (fluid receiving unit) CP that covers the ejection surface Ha of the head H, a wiping mechanism WP that wipes the ejection surface Ha and a tank mechanism (fluid tank) TK that stores ink which is to be discharged from the head H. The tank TK is connected to a suction mechanism SC such as a suction pump.

Figure 2:
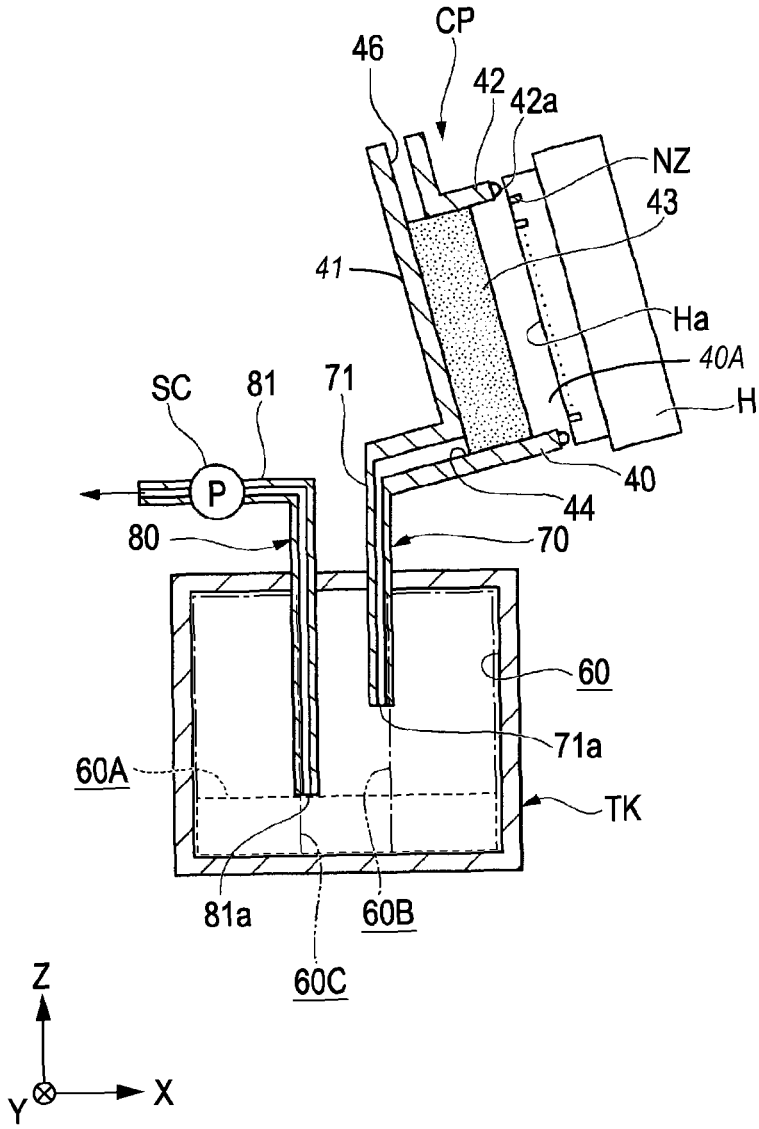
FIG. 2 is a sectional view of a portion of the configuration of the printing device according to the present embodiment.

FIG. 2 is a sectional view showing a configuration of the head H, the capping mechanism CP, the tank TK and the suction mechanism SC. As shown in FIG. 2, the capping mechanism CP includes a cap member 40. The cap member 40 has, for example, a bottom 41 and an edge 42. The cap member 40 is formed in a rectangular shape as viewed from the side of the ejection surface Ha of the head H.

The bottom 41 has a bottom surface which is formed as a flat surface. The bottom surface is oriented, for example, relative to the ejection surface Ha. The edge 42 is disposed on the periphery of the bottom 41 and is formed, for example, so as to surround the area in a rectangular shape as viewed from the side of the ejection surface Ha. The edge 42 is formed, for example, in a wall shape on the periphery of the bottom 41. The edge 42 is provided with a sealing member 42*a* on the end face thereof at the side of the ejection surface Ha.

The sealing member 42*a* is formed of a material such as resin which is capable of elastic deformation. The sealing member 42*a* abuts, for example, the ejection surface Ha of the head H so as to be capable of sealing the ejection surface Ha. A space which is surrounded by the edge 42 on the bottom 41 serves as a container 40*a* that temporarily contains ink therein in order to prevent ink from being spilled. An ink holding member 43 is disposed within the container 40*a*.

The bottom 41 is provided with an ink communication path 44 on the lower side in the gravity direction (the negative Z axis side). The ink communication path 44 is connected to the ink inlet unit 70. The ink inlet unit 70 has an ink inlet tube 71 which is connected to the tank TK. The ink inlet unit 70 permits ink to flow into the tank TK via the ink inlet tube 71. The ink communication path 44 is formed such that, for example, ink discharged from the head H flows therein.

Further, an air release port 46 is disposed on one of the four walls forming the edge 42 which is located, for example, on the positive Z axis side. The air release port 46 has a through hole that communicates between the inside and outside of the container 40*a*. The air release port 46 is provided with, for example, a solenoid valve which is not shown. The solenoid valve is configured to open and/or close in accordance with control performed by the controller CONT.

The tank TK has an ink chamber 60 that stores ink which flows from the capping mechanism CP. The ink inlet tube 71 is partially inserted into the ink chamber 60 and has an ink inlet port 71*a* at the end thereof. The ink inlet port 71*a* communicates with the capping mechanism CP via the ink inlet tube 71.

The ink chamber 60 contains an ink D therein. The medium components of the ink D contained in the ink chamber 60 are capable of being delivered to the capping mechanism CP via the ink inlet port 71*a* and the ink inlet tube 71. Accordingly, the ejection surface Ha (or nozzles NZ) of the head H can be humidified, for example, by the ejection surface Ha being capped by the capping mechanism CP.

The suction mechanism SC is capable of suctioning the inside of the ink chamber 60 of the tank TK. For example, a suction pump is used as the suction mechanism SC. The suction mechanism SC is connected to the ink outlet unit 80. The ink outlet unit 80 has an ink outlet tube 81 that is connected to the ink chamber 60 of the tank TK. The ink outlet unit 80 permits ink to flow out from the ink chamber 60 of the tank TK via the ink outlet tube 81. The ink outlet tube 81 is partially inserted into the ink chamber 60 and has an ink outlet port 81*a* at the end thereof. The ink outlet port 81*a* communicates with the suction mechanism SC via the ink outlet tube 81.

With the configuration according to this embodiment, the suction mechanism SC is connected to the ink chamber 60 via the ink outlet tube 81 and the ink outlet port 81*a*, and the ink chamber 60 is connected to the container 40*a* of the capping mechanism CP via the ink inlet port 71*a* and the ink inlet tube 71. This makes it possible for the ink chamber 60 and the container 40*a* to be suctioned by the suction mechanism.

Figure 3:
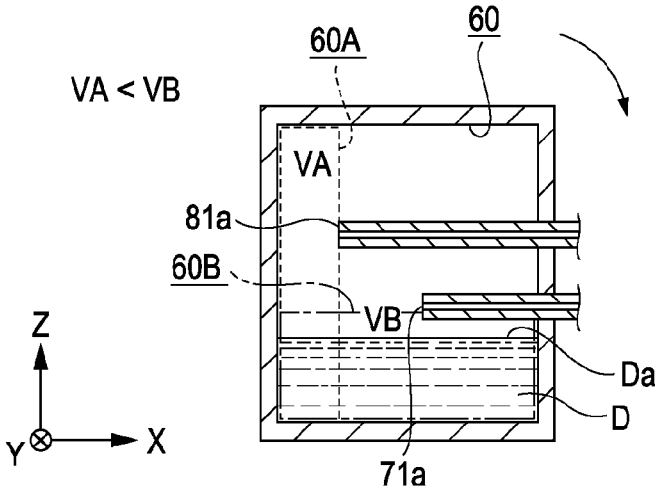
FIG. 3 is a sectional view of a portion of the configuration of the printing device according to the present embodiment.

Next, the positioning of the ink inlet port 71*a* and the ink outlet port 81*a* in the ink chamber 60 will be described below. A space in the ink chamber 60 of the tank TK below the ink outlet port 81*a* in the vertical direction (the negative Z axis side) in a first state (for example, as shown in FIG. 2) for ejecting ink onto the medium M or the like from the head H is defined as a reference space 60A, while a space in the ink chamber 60 of the tank TK below the ink inlet port 71*a* in the vertical direction in a second state (for example, as shown in FIG. 3) that is inclined, for example, by 90 degrees with respect to the state shown in FIG. 2 is defined as a space 60B. The ink inlet port 71*a* and the ink outlet port 81*a* are positioned such that the volume of the reference space 60A is smaller than the volume of the space 60B. That is, when the volume of the reference space 60A and the space 60B are defined as VA and VB, respectively, the ink inlet port 71*a* and the ink outlet port 81*a* are positioned so as to satisfy the following expression:

$$VA<VB \tag{1}$$

The suction mechanism SC suctions ink which is in contact with the ink outlet port 81*a* and does not suction ink which is not in contact with the ink outlet port 81*a*. As a consequent, ink which is located below the ink outlet port 81*a* in the vertical direction is not suctioned by the suction mechanism SC, since it is not in contact with the ink outlet port 81*a*. Accordingly, a maximum volume of ink contained in the ink chamber 60 of the tank TK in the state shown in FIG. 2 corresponds to the reference volume VA of the space below the ink outlet port 81*a* in the vertical direction.

In this embodiment, the reference volume VA is smaller than the volume of the space 60B. As a result, even when the fluid tank is in the second state shown in FIG. 3, the top surface Da of the ink D is below the ink inlet port 71*a* in the vertical direction (the negative Z axis side). Accordingly, the ink D is not in contact with the ink inlet port 71*a*, thereby preventing the ink D in the ink chamber 60 from flowing back into the capping mechanism CP through the ink inlet port 71*a*.

Figure 4:
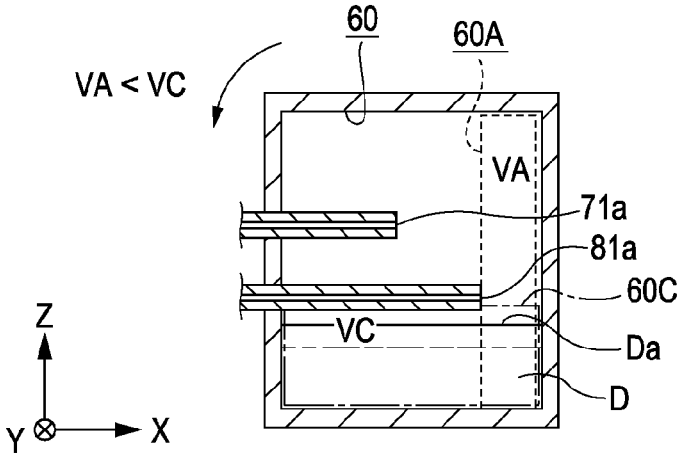
FIG. 4 is a sectional view of a portion of the configuration of the printing device according to the present embodiment.

Moreover, in this embodiment, the ink inlet port 71*a* is positioned on the positive X axis side with respect to the center of the ink chamber 60 in the X direction. As a result, when the ink inlet port 71*a* is in the second state, for example, which is shown in FIG. 4, the value of VB becomes larger than that which is shown in FIG. 3. Accordingly, the above expression (1) is satisfied, thereby also preventing the ink D from flowing back into the capping mechanism CP.

In addition to the above expression (1), in this embodiment, a space in the ink chamber 60 of the tank TK below the ink outlet port 81*a* in the vertical direction in the second state (for example, as shown in FIG. 4, which is another example of the second state) is defined as a space 60C. The ink inlet port 71*a* and the ink outlet port 81*a* are positioned such that the volume VC of the space 60C is larger than the reference volume VA. That is, the ink inlet port 71*a* and the ink outlet port 81*a* are positioned so as to satisfy the following expression:

$$VA<VC \quad (2)$$

According to the invention, even when the tank TK is in the second state shown in FIG. 4, the top surface Da of the ink D is below the ink outlet port 81*a* in the vertical direction. This allows the ink D not to be in contact with the ink outlet port 81*a*, thereby preventing the ink D in the ink chamber 60 from excessively flowing out from the ink outlet port 81*a*. Accordingly, this ensures that the ink D can be retained in the ink chamber 60, thereby allowing the ejection surface Ha to be humidified with certainty.

Moreover, in this embodiment, the ink outlet port 81*a* is positioned on the negative X axis side with respect to the center of the ink chamber 60 in the X direction. As a result, when the ink outlet port 81*a* is in the second state, for example, which is shown in FIG. 3, the value of VC becomes larger than that which is shown in FIG. 4. Accordingly, the above expression (2) is satisfied, thereby also preventing the ink D in the ink chamber 60 from excessively flowing out from the ink outlet port 81*a*.

Figure 5:
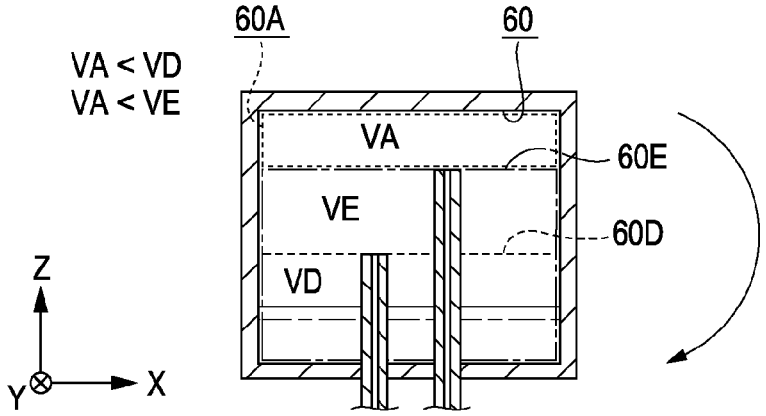
FIG. 5 is a sectional view of a portion of the configuration of the printing device according to the present embodiment.

In addition to the above expressions (1) and (2), a space in the ink chamber 60 of the tank TK below the ink inlet port 71*a* in the vertical direction in a third state (for example, as shown in FIG. 5), that is inclined by 180 degrees with respect to the first state is defined as a space 60D. The ink inlet port 71*a* and the ink outlet port 81*a* are positioned such that the volume of the VD is larger than the reference volume VA. That is, the ink inlet port 71*a* and the ink outlet port 81*a* are positioned so as to satisfy the following expression:

$$VA<VD \quad (3)$$

Accordingly, even when the tank TK is in the third state, the top surface Da of the ink D is below the ink inlet port 71*a* in the vertical direction. This allows the ink D not to be in contact with the ink inlet port 71*a*, thereby preventing the ink D in the ink chamber 60 from flowing back into the capping mechanism CP through the ink inlet port 71*a*.

Moreover, in addition to the above expressions (1) to (3), a space in the ink chamber 60 of the tank TK below the ink outlet port 81*a* in the vertical direction in the third state which is shown in FIG. 5 is defined as a space 60E. The ink inlet port 71*a* and the ink outlet port 81*a* are positioned such that the volume of the VE is larger than the reference volume VA. That is, the ink inlet port 71*a* and the ink outlet port 81*a* are positioned so as to satisfy the following expression:

$$VA<VE \quad (4)$$

Accordingly, even when the tank TK is in the third state, the top surface Da of the ink D is below the outlet port 81*a* in the vertical direction. This allows the ink D not to be in contact with the ink outlet port 81*a*, thereby preventing the ink D in the ink chamber 60 from excessively flowing out from the ink outlet port 81*a*.

Figure 6:
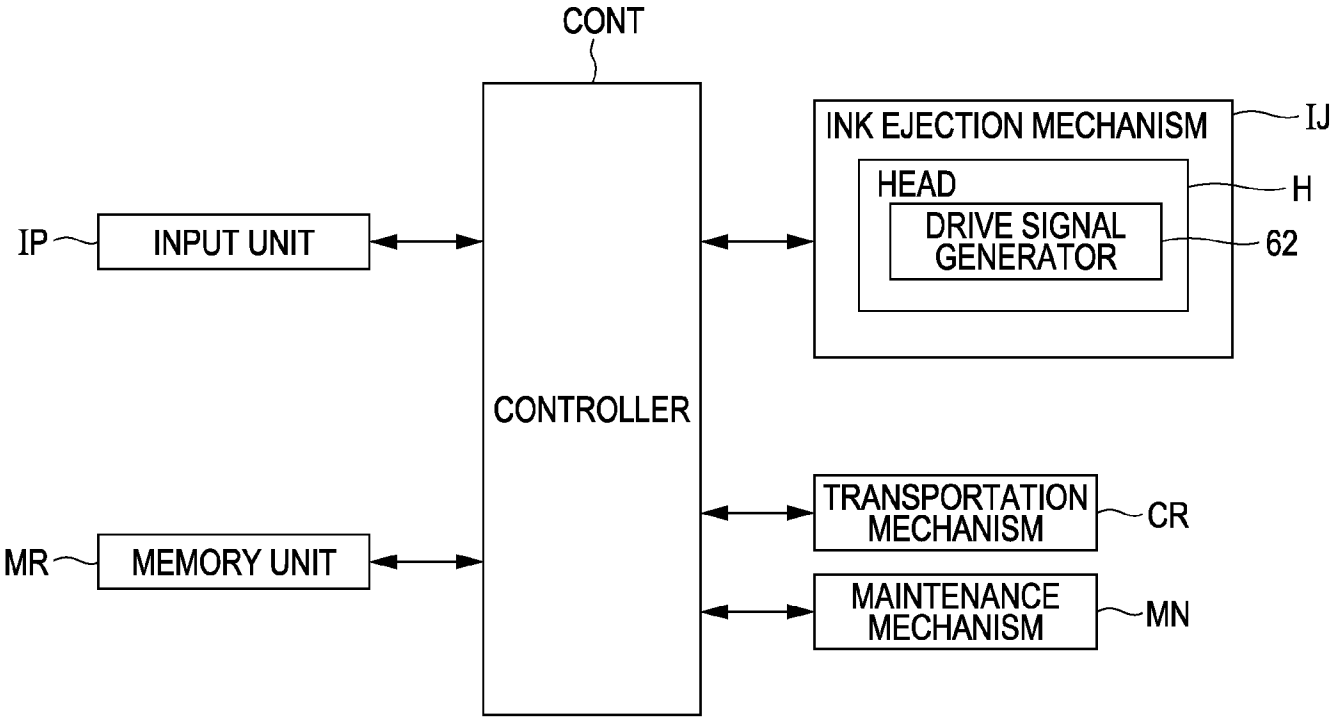
FIG. 6 is a block diagram of an electric configuration of the printing device according to the present embodiment.

FIG. 6 is a block diagram of an electric configuration of the printing device PRT. The printing device PRT in this embodiment includes a controller CONT that controls the entire operation. The controller CONT is connected to an input unit 59 that receives various information on the operations of the printing device PRT and a memory unit MR that stores various information on the operations of the printing device PRT.

The controller CONT is connected to each of parts of the printing device PRT such as an ink jet mechanism IJ, a transportation mechanism CR and a maintenance mechanism MN. The printing device PRT is provided with a drive signal generator 62 that generates drive signals to be input to the head H. The drive signal generator 62 is connected to the controller CONT.

The drive signal generator 62 receives data indicative of the amount of change in voltage of ejection pulses which is input to the head H and timing signals that regulate the timing to change the voltage of the ejection pulses. The drive signal generator 62 generates drive signals such as ejection pulses based on the received data and timing signals.

Next, operations of the printing device PRT having the above-mentioned configuration will be described below. When performing a printing operation with the head H, the controller CONT places the medium M on the support surface 13*a* by the transportation mechanism CR. After placing the medium M, the controller CONT inputs the drive signals to the head H based on the image data of the image to be printed. With this operation, ink is ejected in the negative x direction through the nozzles NZ which are formed in the ejection surface Ha of the head H. Then, the ejected ink forms the image as desired on the medium M.

The controller CONT performs a maintenance operation on the head H such as a capping operation and a discharging (cleaning) operation of ink in the cap member 40. When performing the capping operation, the controller CONT places the head H in the home position in which the head H and the cap member 40 are opposed with each other.

Then, the controller CONT finely adjusts the position of the cap member 40 so that the ejection surface Ha of the head H is in parallel with the cap member 40. At the same time, the controller CONT presses the cap member 40 toward the head H by rotating the cam member which is not shown. As a result of this operation, the space between the cap member 40 and the head H is sealed.

After the head H abuts the cap member 40, the controller CONT actuates the suction mechanism SC, for example, with the air release port 46 being closed. The container 40*a* that communicates with each of the ink outlet tube 81, the ink chamber 60, the ink inlet tube 71, all of which communicate with the suction mechanism SC, is suctioned by the suction mechanism SC to be under a negative pressure. This negative pressure causes ink to be suctioned (discharged) in the negative x direction through the respective nozzles NZ of the head H so that the proper viscosity of ink in the nozzles NZ is maintained.

Ink suctioned (discharged) through nozzles NZ flows from the ink communication path 44 into the ink chamber 60 of the tank TK via the ink inlet tube 71 and the ink inlet port 71*a*. The ink D which flows into the ink chamber 60 is gradually accumulated, and then, suctioned from the ink outlet port 81*a* when the top surface Da comes into contact with the ink outlet port 81*a*. As a result, the ink D having a volume VA maintained in the ink chamber 60. The ink D humidifies the inside of the cap member 40 via the ink inlet port 71*a* and the ink inlet tube 71, for example, by vaporizing the solvent. This makes it possible to humidify the ejection surface Ha (nozzles NZ) of the head H without providing an ink absorbent material in the cap member 40.

After the completion of the suctioning operation of ink, the controller CONT opens the air release port 46. As a result of this operation, the container 40*a* of the cap member 40 is opened to air and the negative pressure is released. After the release of the negative pressure, the controller CONT again performs a suctioning by the suction mechanism SC with the sealing member 42*a* and the ejection surface Ha of the head H being in contact with each other. As a result of this operation, ink stored in the ink absorbent material 43 flows into the tank TK via the ink communication path 44. Then, the controller CONT moves the cap member 40 away from the head H and completes the suctioning operation.

In the course of the above-mentioned operations, the printing device PRT may be inclined (for example, when the printing device falls) or upside down (for example, during transportation). In this case ink may flow, for example, toward the opening of the cap member, causing ink to be deposited on the ejection surface of the head during the capping operation or the like.

However, in this embodiment, the ink inlet port 71*a* and the ink outlet port 81*a* are positioned such that the volume of the reference space 60A in the ink chamber 60 is smaller than the volume of the space 60B. As a result, even when the tank TK is in the second state, the top surface Da of the ink D is below the ink inlet port 71*a* in the vertical direction. Accordingly, the ink D is not in contact with the ink inlet port 71*a*, thereby preventing the ink D in the ink chamber 60 from flowing back into the capping mechanism CP through the ink inlet port 71*a*. Therefore, it is possible to prevent the fluid from being deposited on the ejection surface Ha, thereby preventing the ejection environment from deteriorating.

The technical scope of the invention is not limited to the above-mentioned embodiment, and modifications can be made as appropriate without departing from the spirit of the invention. For example, the arrangement of the ink inlet port 71*a* and the ink outlet port 81*a* is not limited to that of the above-mentioned embodiment, and other arrangement may also be used.

For example, although the arrangement of the ink inlet port 71*a* and the ink outlet port 81*a* has been described as satisfying all the above expressions (1) to (4) in the above-mentioned embodiment, the arrangement is not limited to that of the above-mentioned embodiment, and the arrangement that satisfies at least the expression (1) may also be used. As a matter of course, the arrangement that also satisfies the expressions (2) to (4) is desirable.

Figure 7:
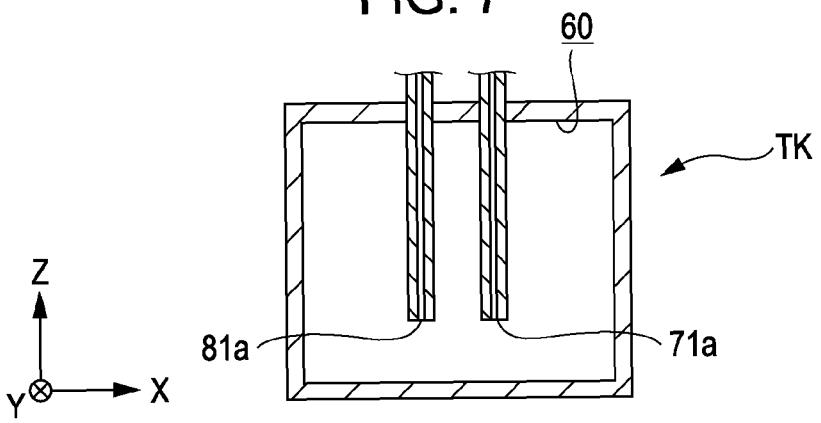
FIG. 7 is a sectional view of other configuration of the printing device according to the present embodiment.

Further, for example as shown in FIG. 7, the ink inlet port 71*a* may be of the same height (Z coordinate) as that of the ink outlet port 81*a*. Further, both the ink inlet port 71*a* and the ink outlet port 81*a* are positioned on the negative Z axis side with respect to the center of the ink chamber 60. In this case, the reference volume VA can be reduced.

Figure 8:
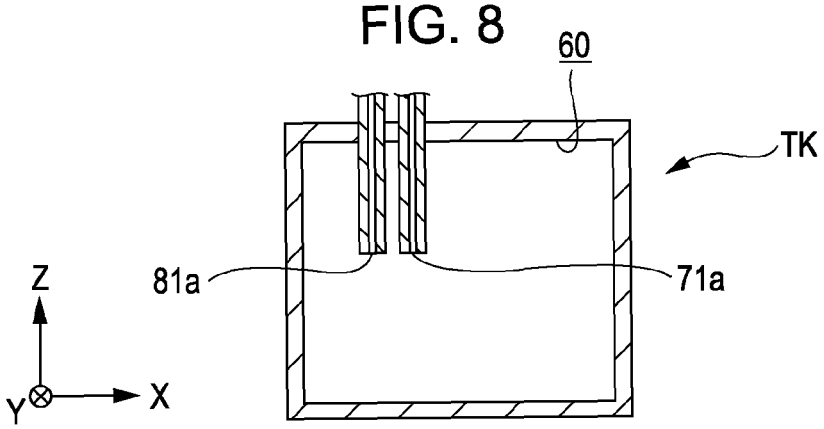
FIG. 8 is a sectional view of other configuration of the printing device according to the present embodiment.

Further, for example as shown in FIG. 8, the ink inlet port 71*a* and the ink outlet port 81*a* may be of the same height (Z coordinate) and both may be positioned on the positive Z axis side with respect to the center of the ink chamber 60. Further, in FIG. 8, both the ink inlet port 71*a* and the ink outlet port 81*a* are positioned on the negative X axis side with respect to the center of the ink chamber 60. Thus, the position of the ink inlet port 71*a* and the ink outlet port 81*a* may be varied in the X direction.

Figure 9:
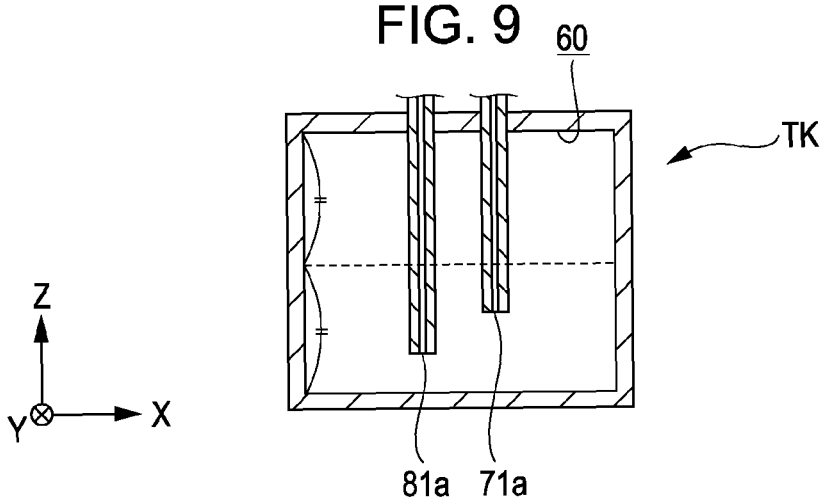
FIG. 9 is a sectional view of other configuration of the printing device according to the present embodiment.

Further, for example as shown in FIG. 9, both the ink inlet port 71*a* and the ink outlet port 81*a* may be positioned on the negative Z axis side with respect to the center of the ink chamber 60 while positioning the ink inlet port 71*a* on the positive Z axis side with respect to the ink outlet port 81*a*.

Further, although the arrangement of the ejection surface Ha of the head H has been described as being inclined with respect to the horizontal plane, the arrangement is not limited to that of the above-mentioned embodiment, and the invention is applicable, for example, to the arrangement of the ejection surface Ha that is parallel to the horizontal plane.

Further, the ink inlet tube 71 and the ink outlet tube 81 of the above-mentioned description may be formed of a flexible material and arranged to be deformable as appropriate in the ink chamber 60. In this case, the ink inlet port 71*a* and the ink outlet port 81*a* may be arranged as having a float member so as to float on the ink D. This causes the ink inlet port 71*a* and the ink outlet port 81*a* to be separated from the top surface Da of the ink D with certainty.

Although the configuration in which the ink inlet tube 71 is used as the ink inlet unit 70 has been described, the configuration is not limited to that of the above-mentioned embodiment, and any configuration other than tubular shape that permits ink or the like to flow therein may be used. For example, a configuration may be used in which a projection having a through hole is formed on a part of the inner wall of the tank TK so that the through hole extends between the inside and outside of the inner wall and the ink inlet tube 71 is connected to the through hole. In this case, an opening of the through hole serves as the ink inlet port 71*a* and the ink inlet unit 70 includes the projection on the wall. The same applies to the ink outlet tube 81 that is used as the ink outlet unit 80.

Although the fluid ejecting apparatus of the invention is applied to the ink jet printer in the above-mentioned embodiment, the invention may be applied to a fluid ejecting apparatus that ejects fluid other than ink. That is, the invention may be applied to various fluid ejecting apparatuses having a fluid ejecting head or the like that ejects fine liquid droplets. It should be noted that the liquid droplets means liquid that is ejected from the liquid ejecting apparatuses and are intended to include liquid in a particle, tear drop or string shape. Further, the fluid as described herein may be any material that can be ejected from fluid ejecting apparatuses.

For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of fluid include ink as mentioned in the above embodiment. The ink as described herein includes various fluid components such as general water-based ink, oil-based ink, gel ink and hot melt ink.

Specific examples of fluid ejecting apparatus may include, for example, fluid ejecting apparatuses that eject fluid containing materials such as electrode material and color material in a dispersed or dissolved state, which are used for manufacturing of liquid crystal displays, EL (electroluminescence) displays, surface emitting displays or color filters, fluid ejecting apparatuses that eject bioorganic materials used for manufacturing biochips, fluid ejecting apparatuses that are used as a precision pipette and eject fluid of a sample, textile printing apparatuses and micro dispensers.

Examples of fluid ejecting apparatus may further include fluid ejecting apparatuses that eject lubricant to precision instrument such as a clock or camera in a pinpoint manner, fluid ejecting apparatuses that eject transparent resin liquid such as ultraviolet cured resin onto a substrate for manufacturing of minute hemispheric lenses (optical lenses) used for optical communication elements or the like, and fluid ejecting apparatuses that eject acid or alkali etching liquid for etching a substrate or the like.

The entire disclosure of Japanese Patent Application No. 2010-134237, filed Jun. 11, 2010 is expressly incorporated by reference herein.

What is claimed is:

1. A fluid ejecting apparatus comprising:

a fluid ejecting head that ejects fluid;

a fluid receiving unit that receives the fluid ejected from the fluid ejecting head;

a suction unit that applies a suction force to the fluid receiving unit; and a fluid tank having a fluid inlet unit through which the fluid which has been received in the fluid receiving unit flows into a fluid chamber via a fluid inlet port and a fluid outlet unit through which the fluid in the fluid chamber flows into the suction unit via a fluid outlet port, wherein a maximum volume of the fluid contained in the fluid chamber having an upper limit at the bottom of the fluid outlet port in the vertical direction in the fluid tank in a first state for ejecting the fluid from the fluid ejecting head to the fluid receiving unit is smaller than a volume of a space having an upper limit at the bottom of the fluid inlet port in the vertical direction in the fluid tank in a second state that is inclined by 90 degrees with respect to the first state, wherein the second state includes when the fluid inlet is positioned above the fluid outlet and when the fluid inlet is positioned below the fluid outlet.

2. The fluid ejecting apparatus according to claim 1, wherein the volume of a space having an upper limit at the bottom of the fluid inlet port in the vertical direction in the fluid tank in a third state that is inclined by 180 degrees with respect to the first state is larger than the maximum volume of the fluid contained in the fluid chamber in the first state.

3. The fluid ejecting apparatus according to claim 1, wherein the volume of a space having an upper limit at the bottom of the fluid outlet port in the vertical direction in the fluid tank in the second state is larger than the maximum volume of the fluid contained in the fluid chamber in the first state.

4. The fluid ejecting apparatus according to claim 3, wherein the volume of a space having an upper limit at the bottom of the fluid outlet port in the vertical direction in the fluid tank in the third state is larger than the maximum volume of the fluid contained in the fluid chamber in the first state.

5. The fluid ejecting apparatus according to claim 1, wherein the fluid tank stores the fluid therein.

6. The fluid ejecting apparatus according to claim 1, wherein the fluid ejecting head is arranged so that the ejection surface that ejects the fluid is inclined with respect to the horizontal plane.

7. The fluid ejecting apparatus according to claim 1, wherein the fluid receiving unit is provided so as to be capable of forming a sealed space between the fluid receiving unit and the ejection surface and wherein the fluid receiving unit has an air release port that is capable of allowing communication between the sealed space and air.

* * * * *